United States Patent [19]

Kennedy

[11] 4,290,602

[45] Sep. 22, 1981

[54] SPORTS FIELD BARRIER AND METHOD OF CONSTRUCTING SAME

[76] Inventor: Robert B. Kennedy, 8925 Huntcliff Lake Ct., Atlanta, Ga. 30338

[21] Appl. No.: 34,126

[22] Filed: Apr. 27, 1979

[51] Int. Cl.[3] ..... A63B 61/00

[52] U.S. Cl. ..... 273/29 R; 256/23; 256/32

[58] Field of Search ..... 256/45, 35, 33, 34, 256/36, 32, 1, 12.5, 26, 27, 23; 273/29 R, 29 A, 26 A, 411; 272/3

[56] References Cited

U.S. PATENT DOCUMENTS

| | | | |
|---|---|---|---|
| 1,127,493 | 2/1915 | Nagy | 256/26 UX |
| 2,819,901 | 1/1958 | Matela | 273/26 A X |
| 3,651,851 | 3/1972 | Curtis | 256/33 X |
| 3,697,068 | 10/1972 | McDougall | 273/26 A X |

FOREIGN PATENT DOCUMENTS

| | | | |
|---|---|---|---|
| 2207833 | 5/1978 | Fed. Rep. of Germany | 256/32 |
| 2282504 | 3/1976 | France | 256/13.1 |
| 18900 | of 1901 | United Kingdom | 273/411 |
| 312960 | 6/1929 | United Kingdom | 256/13.1 |
| 1524824 | 9/1978 | United Kingdom | 256/45 |

*Primary Examiner*—Andrew V. Kundrat

[57] ABSTRACT

A sports field barrier is disclosed for arresting the flight of a ball moving in one direction over a field of play and for rebounding the ball in another direction generally and usually reciprocal to the one direction and with the barrier being erected uprightly along a zigzag course adjacent the field of play. Where the sports field is a tennis court the barrier may be constructed by the steps of intertwining wire coils to form a section of wire mesh fencing, crimping the fencing section or mounting it to forms so as to form the wire coils into a zigzag shape, and mounted the fencing section to a fence frame with the coils stretched between a pair of upright stanchions.

9 Claims, 6 Drawing Figures

SPORTS FIELD BARRIER AND METHOD OF CONSTRUCTING SAME

BACKGROUND OF THE INVENTION

This invention relates to field barriers for sports of the type using a ball and racket such as tennis, to methods of constructing such barriers, and to practice backboard type barriers.

Tennis courts are usually bounded by wire mesh fencing to contain the balls within the courts during play. The fencing is almost invariably formed by upright planar sections of wire mesh streched tightly between upright stanchions anchored in the ground where the court is located out of doors. Though in some cases gaps in the fencing do occur, usually the fence as a whole, together with access gates, completely encloses one or a group of adjacent courts by forming a rectangular barrier.

During the course of play balls are continually hit into the fence from which they usually rebound a short distance. The direction of rebound quite frequently has a vectoral component oriented away from the player who last hit the ball. This is because the angle of ball reflection is equal and opposite to the angle of incidence in accordance with Newton's laws of dynamics. Of course since the barrier is composed of wire mesh, it is not completely flat and thus the angle of incidence is not invariably equal and opposite to the angle of incidence. Nevertheless, generally this is the case. As a result it is seen that a ball will tend to rebound away from the player who last struck it making retrieval by that player more difficult. In addition, since the flight of the ball also will typically pass closely by an opposing player the ball rebound will also usually be away from that player too who is likely to be the one to retrieve it. It therefore is seen that in the majority of incidences tennis court fences of the prior art are constructed to rebound balls away from the players. This in turn makes retrieval more time consuming and, in the case of multiple courts of play bounded by a common fence, often causes the balls in play at one court to interfer with play at an adjacent court.

Windy conditions create an additional problem with present day out of doors tennis court fences. The winds first push the balls into the fence from which they rebound slightly. However, after rebound the wind will again push the ball back into the fence. Since the fence is straight adjacent the court surface the ball soon will begin to roll along the fence until it reaches a downwind corner. With multi-court fences its final resting place may, in some cases, be several courts away from that in which it was in play.

In addition to barriers placed about sports fields other barriers have also been constructed and erected for solo practice. In tennis these are termed backboards and, as opposed to the wire mesh structure of court fences, are constructed of solid materials such as wood or concrete to provide a high degree of rebound for continuous practice. Again here, however, the rebound direction tends to have a vectoral component oriented away from the player in all cases except where the ball is hit normally, i.e. at a 90° angle of incidence, onto the backboard. The further from normal the more aggreviated the condition. In addition, the predictability of return speed and timing is quite great and therefore unnatural. Accordingly, it is to the just described problems associated with sports field barriers to which the present invention is directed.

SUMMARY OF THE INVENTION

In one preferred form of the invention a sports field barrier is provided for arresting the flight of a ball moving in one direction over a field of play and for rebounding the ball generally and usually back in the direction from which it came. This is accomplished by erecting the barrier uprightly along a zigzag course adjacent the field of play.

In another form of the invention a fence is provided for a tennis court which comprises a pair of stanchions adapted to be mounted uprightly adjacent one side of a tennis court and an upright wire mesh barrier extending along a zigzag course between the stanchions.

In another form of the invention a sports field barrier is provided for arresting a ball moving from a linear boundary of a field of play and for rebounding the ball back towards the field of play. The barrier comprises a sequence of generally flat barrier sections mounted uprightly along the linear boundary with one set of alternate sections being mutually parallel and oriented obliquely to the linear boundary. Another set of mutually parallel sections is mounted obliquely to the linear boundary between the sections of the one set. Adjacent sections of the one and of the other set are angularly joined at barrier corners.

In yet another form of the invention a method is provided for constructing tennis court fencing which comprises the steps of intertwinning a plurality of elongated wire coils to form a section of wire mesh fencing, crimping the fencing section so as to form the elongated wire coils into a zigzag shape, and mounting the fencing section to a fence frame with the coils streched between a pair of upright stanchions and with the fencing section suspended from a beam spanning the stanchions.

In still another preferred form of the invention a method is provided for constructing tennis court fencing which comprises the steps of intertwinning a plurality of elongated wire coils to form a section of wire mesh fencing, and intertwinning a plurality of zigzag-shaped forms through the section of wire mesh fencing transverse to the elongated wire coils. The section of fencing is mounted between a pair of upright stanchions with the coils oriented generally parallel with the stanchions whereby the fencing section follows a zigzag course between the stanchions.

DESCRIPTION OF THE PREFERRED EMBODIMENTS

Figure 3:
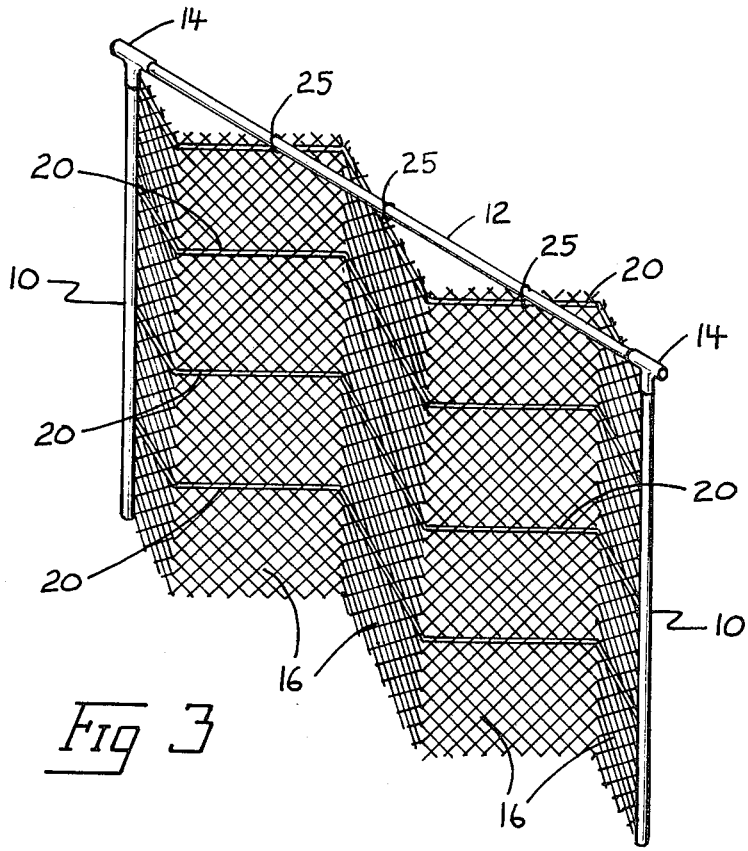
FIG. 3 is a perspective view of one section of a tennis court fence of the present invention which is seen to employ four of the rigid forms shown in FIG. 2.
Figure 4:
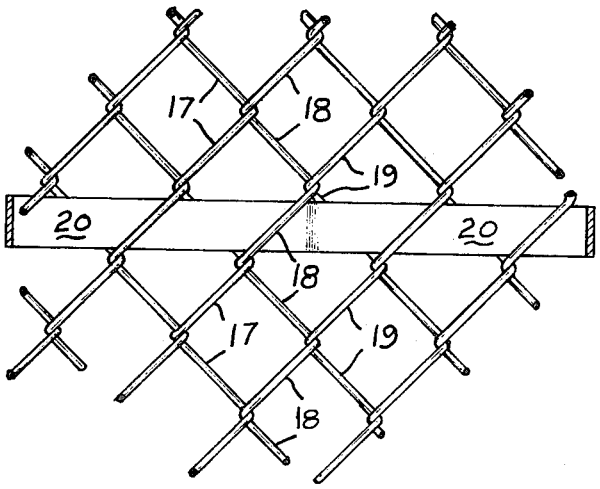
FIG. 4 is a front elevational view of a portion of the fence section or portion shown in FIG. 3.

Referring now in more detail to the drawing, there is shown in FIG. 3 one section of a tennis court fence comprised of a pair of stanchions 10 anchored uprightly in court terrain and which are spanned at their tops by a beam 12. Both the stanchions and beam are of conventional tubular structure which are telescopically received within conventional T couplings 14. The stanchions and beam provide a frame which support wire mesh fencing 16 that also is of conventional structure and gauge. The mesh here is formed of vertically oriented coils of wire that are intertwinned as best seen in FIG. 4 where one coil 18 is seen to be intertwinned with adjacent coils 17 and 19. As opposed to conventional tennis court fences however the wire mesh here is seen to follow a zigzag course between the stanchions 10. This course and shape is maintained by a set of rigid forms 20 which extend along mutually spaced, horizontal planes between stanchions 10. As shown in FIG. 4 the forms 20 are woven through the wire mesh passing in front of coil 19 then behind coil 18, in front of coil 17, and so forth. Depending on the strength of the wire, that is to say its gauge, and the form material, the forms may be woven only through alternate coils or coil sets. The ends of the forms may be secured by unshown clamps to the upright stanchions or left free supported by the wire mesh itself.

Figure 5:
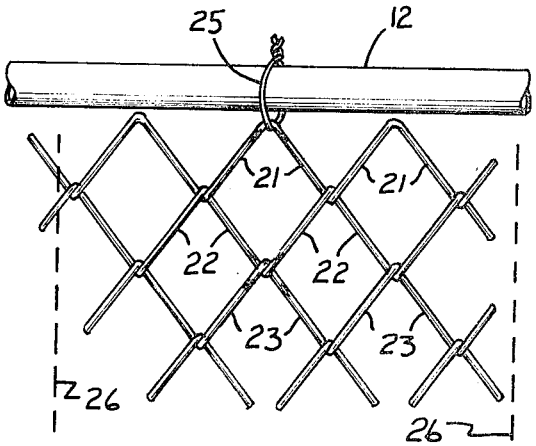
FIG. 5 is a front elevational view of an upper portion of a tennis court fence employing principles of the invention in an alternative form.

As previously explained, the coils forming the just described wire mesh fencing shown in FIGS. 3 and 4 are oriented vertically which makes the fencing horizontally collapsable were it not for the presence of the rigid forms 20. This flexibility enables the mesh to be placed upon the forms or the forms woven through the mesh in errecting the fence. In an alternate embodiment however the individual coils are oriented horizontally as shown in FIG. 5 where coil 22 is seen to be entwinned with coils 21 and 23. This novel orientation of the coils renders the mesh vertically collapsable but relatively rigid horizontally. As a result the mesh may be crimped as along planes 26 to form it permanently into a zigzag shape thereby eliminating the need for forms 20 once it is stretched between stanchions 10 and mounted thereto in conventional fashion as with the use of rigid end bars clamped vertically along side of the stanchions. In such an embodiment mid portions of the mesh should be suspended from beam 12 where it passes therebeneath as with tie wires 25 to prevent sagging.

Figure 2:
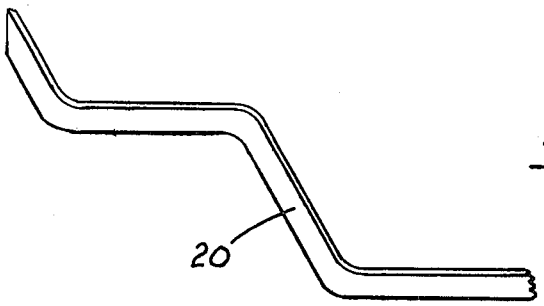
FIG. 2 is a perspective view of a rigid form which may provide a component of a tennis court fence of the invention.
Figure 1:
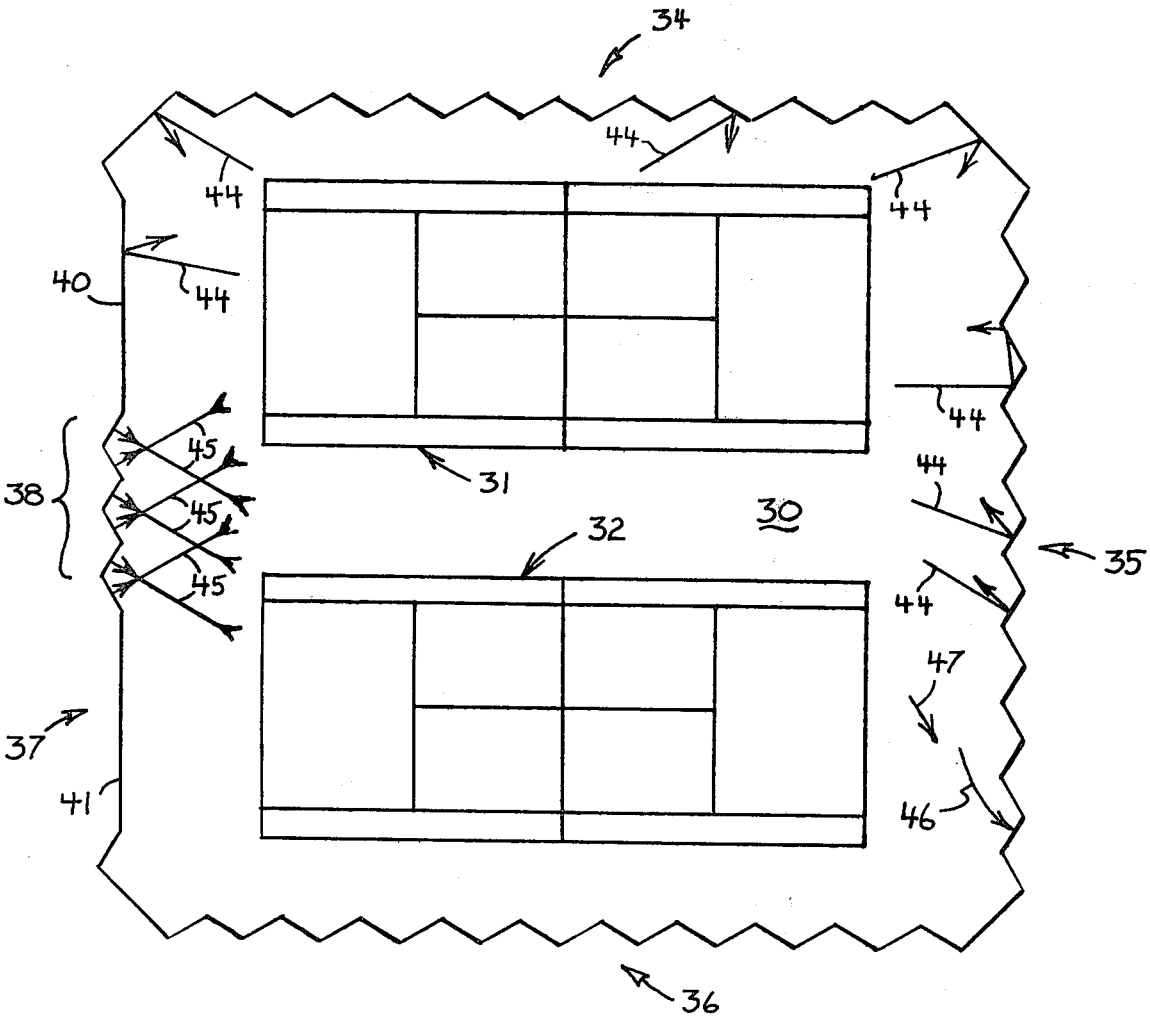
FIG. 1 is a plan view of two tenis courts of play surrounded by a tennis court fence embodying principles of the invention in preferred forms.

FIG. 1 illustrates one plan the just described fencing may take when errected about a tennis court 30 having two adjacent fields of play 31 and 32. Here the fencing takes a continuous zigzag configuration along three sides 34, 35 and 36 adjacent the court boundary. Along the fourth side 37, however, the zigzag course is maintained only along a section 38 between courts 31 and 32. Directly behind courts 31 and 32 are two conventionally straight sections 40 and 41. The difference here in the configuration of sides 35 and 37 is for illustrative purposes only since only one of the two plans would ordinarilly be elected. The straight sections 40 and 41 are located directly behind the fields of play since it is here where the use of the zigzag shape typically provides the lesser degree of improvement in rebound. A selection of typical flight and rebound paths 44 are also shown which illustrate the manner by which the fence tends to direct the balls back towards the players. One set of such paths 45 illustrates how balls which would ordinarilly rebound from one court into another are actually directed from both courts back to the particular court from which they came. Another path 46 also illustrates how the fence tends to halt a ball driven as by a cross-wind in the direction of vector 47 which otherwise would roll into a far corner of the court.

Figure 6:
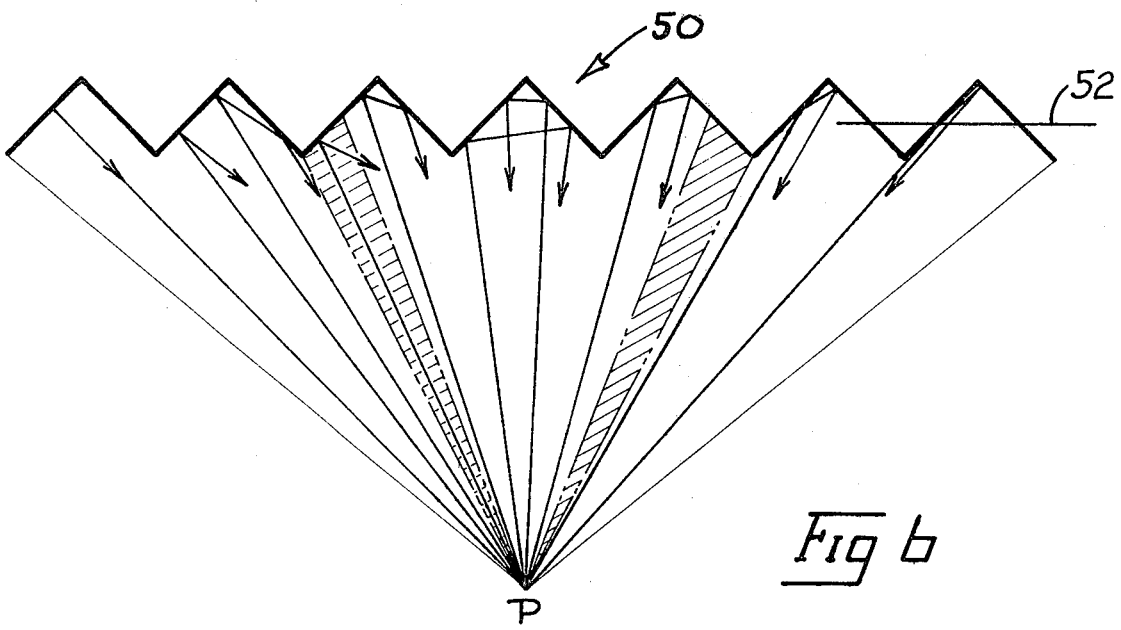
FIG. 6 is a plan view of a backboard for tennis practice incorporating principles of the invention together with representations of several different ball flight and rebound paths.

With reference next to FIG. 6 a backboard 50 is shown having a zigzag configuration. The backboard may be of solid material such as wood or concrete with adjacent sections of the board merging at right angles. Being solid instead of wire mesh structure, balls may be easily struck with sufficient force to rebound back to a player to be struck repeatedly. From FIG. 6 it is apparent that in most cases the balls rebound back towards a Player P. Only in the two small shaded areas do the balls rebound sufficiently away from the player as to impair substantially his chances of another hit. It will also be seen that in many instances the ball will strike two adjacent sections of the backboard. This action provides a change in the distance and thus the round-trip timing of flight which more accurately simulates actual play conditions. With this type backboard a player is actually encouraged to hit balls at various angles rather than merely straight ahead. In addition, several players may stand side by side and use the backboard with most of the balls returning to the individual player who hit it even though it should strike the backboard in front of an adjacent player!

The individual planar sections of the just described barriers may be joined together at various angles. Thus, the backboard illustrated in FIG. 6 has sections oriented some 45° to the major plane 52 or composite orientation of the barrier between stanchions while the fence sections of FIGS. 1 and 3 are oriented some 30° to its major plane which is to say the plane in which stanchions 10 and beam 12 lie. The junctions or corners of the various sections are shown as being rather sharp and well defined. They can, however, be rounded somewhat. Balls will, on occasion, strike these corners that project towards the player which, in those cases where the center of the ball is located beyond the corner, will create an adverse rebound. Instances of this occurrance can be minimized through the use of relatively long sections of barrier relative to ball diameter. Thus, the chance of this occurring with a 2½ inch diameter tennis ball on a barrier with 4 foot sections is only about 1 chance in 40 at any corner or 1 chance in about 80 at the outwardly projecting corners.

It thus is seen that a sports field barrier is provided which tends to rebound balls back in the direction from which they came. Though there is a small increase in material costs over that of the prior art barriers, the new barrier is of rather simple economic construction which may comprise existing wire mesh. Use of the barrier reduces the time and effort spent in retreiving balls which speeds up play. Interference between play on adjacent courts is also significantly reduced.

It should be understood that the just described embodiments merely illustrate principles of the invention in selected preferred forms. Many modifications, additions and deletions may, of course, be made thereto without departure from the spirit and scope of the invention as set forth in the following claims.

What is claimed is:

1. A sports field barrier for arresting the flight of a ball moving in one direction over a field of play and for rebounding the ball in another direction generally and usually reciprocal to the one direction and with the barrier being errected uprightly along a zigzag course adjacent the field of play and comprising a pair of mutually spaced stanchions mounted uprightly along said course supporting a beam, and wire mesh fencing including a plurality of intermeshed wire coils extending generally horizontally along said zigzag course mounted to said pair of stanchions and suspended from said beam.

2. A sports field barrier for arresting the flight of a ball moving in one direction over a field of play and for rebounding the ball in another direction generally and usually reciprocal to the one direction and with the barrier being errected uprightly along a zigzag course adjacent the field of play and comprised of a frame having a pair of mutually spaced stanchions mounted uprightly along said course, a plurality of zigzag-shaped forms extending generally horizontally between said stanchions along said zigzag course, and wire mesh fencing comprised of a plurality of intermeshed wire coils extending generally vertically along said zigzag course mounted to said zigzag-shaped forms thereby shaping said fencing.

3. A fence for a tennis court comprising at least one pair of stanchions adapted to be mounted uprightly adjacent one side of the tennis court, an upright wire mesh barrier extending along a zigzag course between said stanchions comprised of a plurality of intermeshed wire coils extending generally horizontally along said zigzag course, and a beam supported by said pair of stanchions from which beam said wire mesh barrier is suspended.

4. A tennis court comprising a playing surface outlined with at least one field of play thereon and a wire mesh fence errected along a course that zigzags back and forth repeatedly between opposite sides of a linear path adjacent said field of play, whereby tennis balls hit against the wire mesh fence tend to be rebounded back towards the field of play in the general direction from which they were hit.

5. A tennis court in accordance with claim 4 wherein said wire mesh fence includes a plurality of intermeshed wire coils extending generally horizontally.

6. A tennis court comprising a playing surface outlined with at least one field of play thereon, and a wire mesh fence errected along a zigzag course adjacent said field of play that includes a plurality of generally horizontally mounted zigzag forms against which a plurality of intermeshed wire coils are secured, whereby tennis balls hit against the wire mesh fence tend to be rebounded back towards the field of play in the general direction from which they were hit.

7. A method of constructing tennis court fencing comprising the steps of:

(a) intertwinning a plurality of elongated wire coils to form a section of wire mesh fencing:

(b) crimping the fencing section so as to form the elongated wire coils into zigzag shapes; and (c) mounting the fencing section to a fence frame with the coils streched between a pair of upright stanchions and with the fencing section suspended from a beam spanning the stanchions.

8. A method of constructing tennis court fencing comprising the steps of:

(a) intertwinning a plurality of elongated wire coils to form a section of wire mesh fencing;

(b) intertwinning a plurality of zigzag-shaped forms through the section of wire mesh fencing transverse to the elongated wire coils; and (c) mounting the section of fencing between a pair of upright stanchions with the coils oriented generally parallel with the stanchions whereby the fencing section follows a zigzag course between the stanchions.

9. The method of constructing tennis court fencing in accordance with claim 8 wherein steps (a), (b) and (c) are performed sequentially.

* * * * *